United States Patent [19]

Echevarria

[11] 4,221,013

[45] Sep. 9, 1980

[54] FLUID FLOTATION SLEEP SYSTEM

[76] Inventor: Angel M. Echevarria, 5416 La Crescenta Ave., La Crescenta, Calif. 91214

[21] Appl. No.: 890,272

[22] Filed: Mar. 27, 1978

[51] Int. Cl.[2] ..... A47C 27/08

[52] U.S. Cl. ..... 5/451; 5/455

[58] Field of Search ..... 5/365, 368, 369, 370, 5/371, 451, 452, 455

[56] References Cited

U.S. PATENT DOCUMENTS

| | | | |
|---|---|---|---|
| 3,274,624 | 9/1966 | Noerdinger | 5/345 R |
| 3,789,442 | 2/1974 | Yobinick | 5/91 |
| 3,813,716 | 6/1974 | Francis | 5/368 |
| 4,015,299 | 4/1977 | Tinnel | 5/334 C |
| 4,055,867 | 11/1977 | Phillips | 5/368 |
| 4,062,077 | 12/1977 | Autrey | 5/334 C |

FOREIGN PATENT DOCUMENTS

| | | | |
|---|---|---|---|
| 274162 | 10/1965 | Australia | 5/368 |

*Primary Examiner*—Alexander Grosz
*Attorney, Agent, or Firm*—Fraser and Bogucki

[57] ABSTRACT

The exterior of a fluid flotation sleep system such as a waterbed mattress is defined by a pair of registering frame or panel members having resilient borders of substantial height, the upper one of which includes a top pad and a resilient border of rectangular cross-section, fitting around an inclined resilient border attached to a base pad on the lower panel member. A cavity or enclosed volume defined between the two panel members is filled with separate pliant water containers, which may be elongated tubes or have other configurations, and which have only limited stretchability in response to pressures normally exerted by a user. The separate water containers yield locally to user pressure and conform to the user's shape, but do not transmit significant side forces or wave motion to other tubes, thus improving the sleeping characteristics of the surface. A quilted cover surface and side margin are attached to the top cover member, the quilted sleeping surface including foam of a substantial thickness, nominally of the order of 1½" before quilting, to provide a luxurious feel and appearance while supplying added thermal insulation relative to the waterbed. A water barrier or collector sheet may be disposed under the water containers and across the open cavity defined by the upper side of the lower panel. With this construction, the individual tubes may be filled, moved, and emptied very readily. Should leaking occur in a tube it would not damage the floor or furniture.

15 Claims, 5 Drawing Figures

FIG. 3
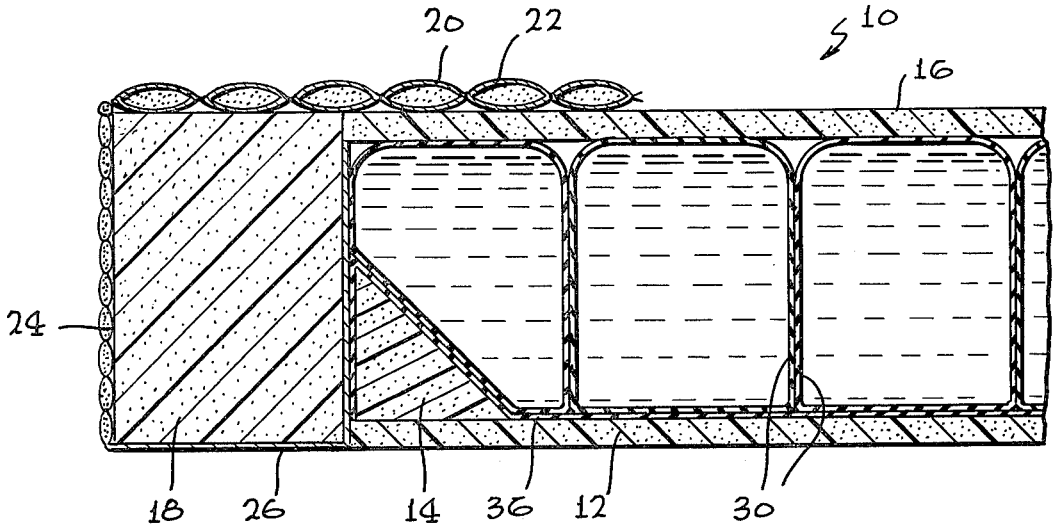
FIG. 4
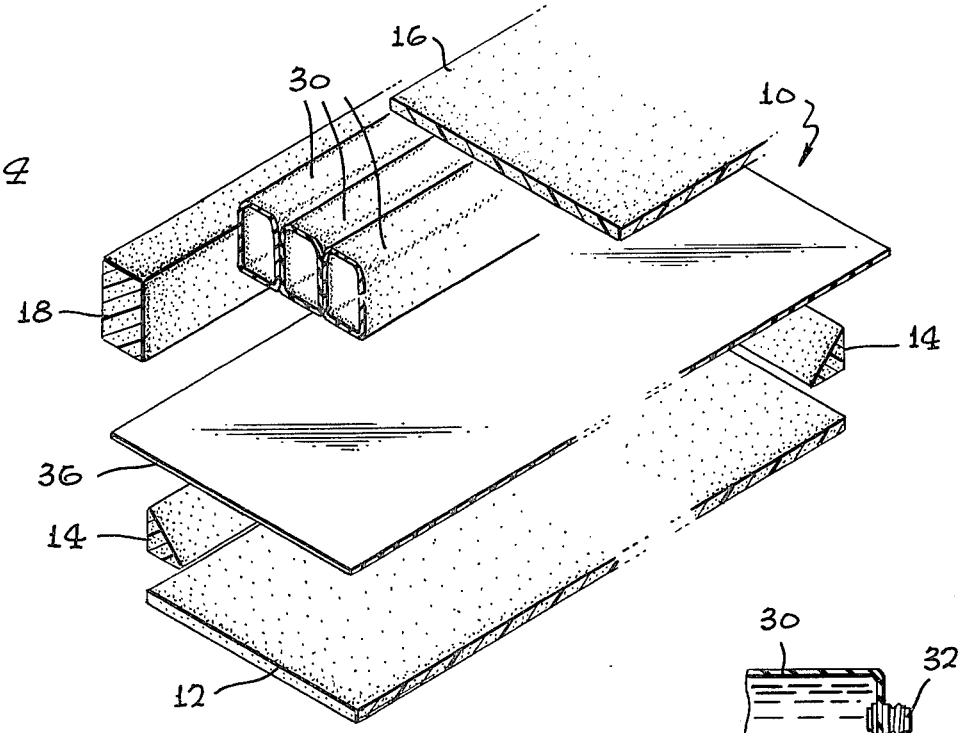
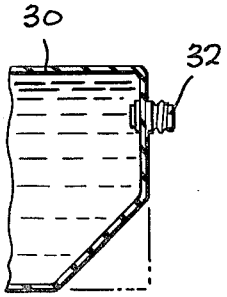
FIG. 5

FLUID FLOTATION SLEEP SYSTEM

BACKGROUND OF THE INVENTION

There has been substantial acceptance and growth of the waterbed industry without, however, significant success having been made in solving certain basic structural and operative problems in the waterbeds themselves. As evidenced by U.S. Pat. Nos. 4,062,077, 3,840,921 and 3,849,814, it is known to provide a large unitary flexible water bladder or liner which provides a substantial sleeping surface area. As may be seen from U.S. Pat. No. 3,849,814, a heavy rigid outer framework, essentially a box frame, can be disposed around the outer periphery of the bladder, to provide only peripheral support. As shown in later filed U.S. Pat. No. 3,840,921, the bladder can instead be bordered by a frame having an inclined surface, so that there is less possibility of encounter with the side frame. Alternatively, as shown in yet later U.S. Pat. No. 4,062,077, the area of the bladder can be somewhat reduced, and the bladder can be encompassed not only by a heavy rigid framework, but also by a resilient side edge of rectangular cross-section which, together with interior padding, helps to provide a firmer margin and mechanical isolation from the rigid framework.

As will be evident upon examining the above-referenced patents, all are subject to several common deficiencies of waterbed mattresses. First, a single large support frame and also a heavy bladder or linear must be employed, and these are difficult to ship and handle even in the unloaded form. Second, the flexible bladder is subject to wave motion, or continuing oscillating response to relatively small motions, and for most persons this is a disturbing and generally unwanted characteristic. Third, the bladder cannot be filled or emptied in the normal bedroom location without using tubing or some type of connection to the closest adjacent water source. It is not feasible to fill a mattress averaging some 500 lbs. and transfer the mattress from one room to another. In addition, once the mattress has been filled it cannot readily be moved for the same reasons. Fourth, should a leak occur during the years in which a mattress is to be used, the most common way in which the leak can be located and remedied is to empty the mattress before or after locating the leak, then to effect the repair, which may require return to the store, and then to refill the mattress. An undetected leak can substantially damage a bedroom and its furnishings, and the dangers of such leakage are well recognized. Further, the weights involved with the heavy frame, large bladder and the large volume of water needed often exceed the permissible floor loading in a residence or apartment structure. In consequence of these factors the practice of prohibiting the installation of waterbeds in apartments has become widespread.

SUMMARY OF THE INVENTION

A fluid flotation sleep system in accordance with the invention utilizes a pair of light weight panel members, arranged as an upper and lower panel member having resilient borders of substantial height, with the border of the lower panel member fitting within the inside of the border of the upper panel member, to define an interior cavity. Within this cavity are disposed a plurality of pliant but substantially nonstretching water containers which are sufficiently small so that the forces exerted by a user of the mattress span at least a number of the containers. The containers need not be filled to capacity and can be operated at low pressures and therefore have long life. The pressures and motions exerted are confined principally within the individual containers, and not transmitted through the adjacent and abutting containers to any substantial extent, so that the mattress conforms to the body of the user and yields in response to movement, but does not oscillate or generate independent motions. Should leakage occur it affects only that particular container which is defective, and the leakage is limited and may be collected within a water barrier disposed underneath the containers. The individual containers may conveniently be carried and the structure has component parts which may be easily handled, so that the entire sleep system may readily be filled, emptied, moved, assembled or disassembled as one wishes.

In a specific example of a fluid flotation sleep system in accordance with the invention, a base structure member is provided having a resilient wedge-shaped border defining the approximate outer periphery of the sleeping surface that is to be water supported, and this is covered by a registering cover member having a rectangular resilient border joined to a foam layer on which is superimposed a thick quilted cover joined to quilted or other side margins and ultimately attached to the inside of the resilient border. The top quilted member has an extremely thick foam interior, of approximately 1½" thickness prior to quilting, which together with the underlying foam layer provides good thermal insulation from the water-filled portion of the structure. In the typical rectangular bed configuration, the water-filled portion of the structure may be defined by a plurality of pliant vinyl tubes lying substantially parallel to the axis of elongation of the bed. Each tube (or other configuration) may be separately filled through a valve element, and by using tubes of 3" to 5" in diameter when filled, a weight in the range of 50–70 lbs. per filled tube can be utilized, permitting even one individual to handle an individual tube, although a tube is more conveniently handled by two people. A water barrier sheet may be disposed on the upper side of the base structure, under the tubes, to collect leaking water if it should occur. If there is leakage the sleeping surface can still be employed. The entire sleeping surface has only a relatively few component parts, except for the number of tubes or containers that are employed, and is light in weight. The containers are so compact that a substantial number of spares may be shipped with each unit. In appearance and feel this sleeping surface approaches the highest quality inner spring construction, while preserving the advantages of the waterbed in a compact and relatively low cost configuration.

BRIEF DESCRIPTION OF THE DRAWINGS

A better understanding of the invention may be had by reference to the following description, taken in conjunction with the accompanying drawings, in which:

FIG. 3 is an end sectional view of a fragment of the waterbed mattress of FIGS. 1 and 2;

FIG. 4 is a fragmentary exploded view of a portion of the waterbed mattress construction; and FIG. 5 is a fragmentary sectional view, taken along the line 5—5 in FIG. 2, and looking in the direction of the appended arrows.

DETAILED DESCRIPTION

Figure 1:
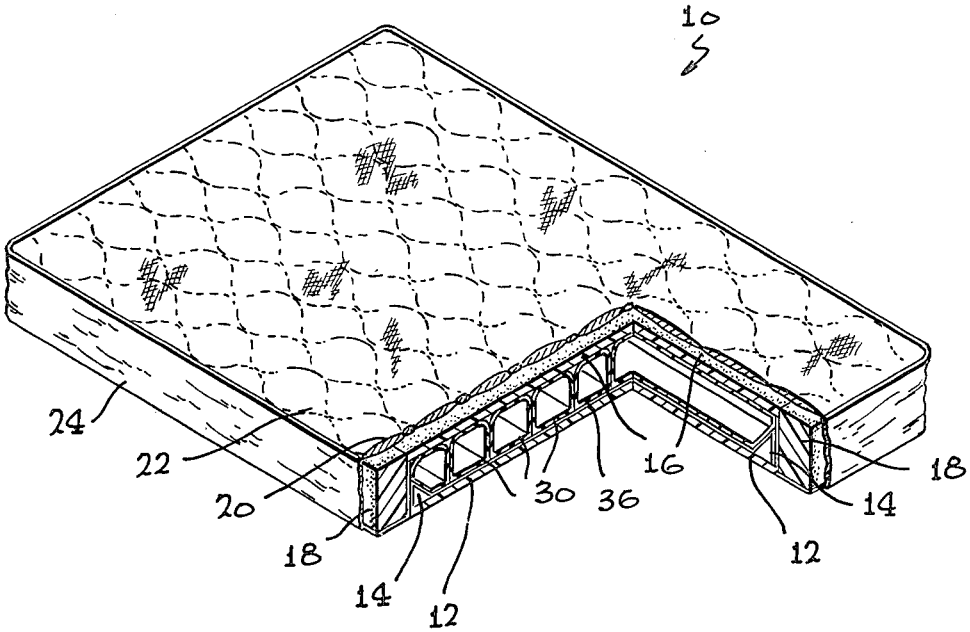
FIG. 1 is a perspective view, partially broken away, of a waterbed mattress in accordance with the invention.
Figure 2:
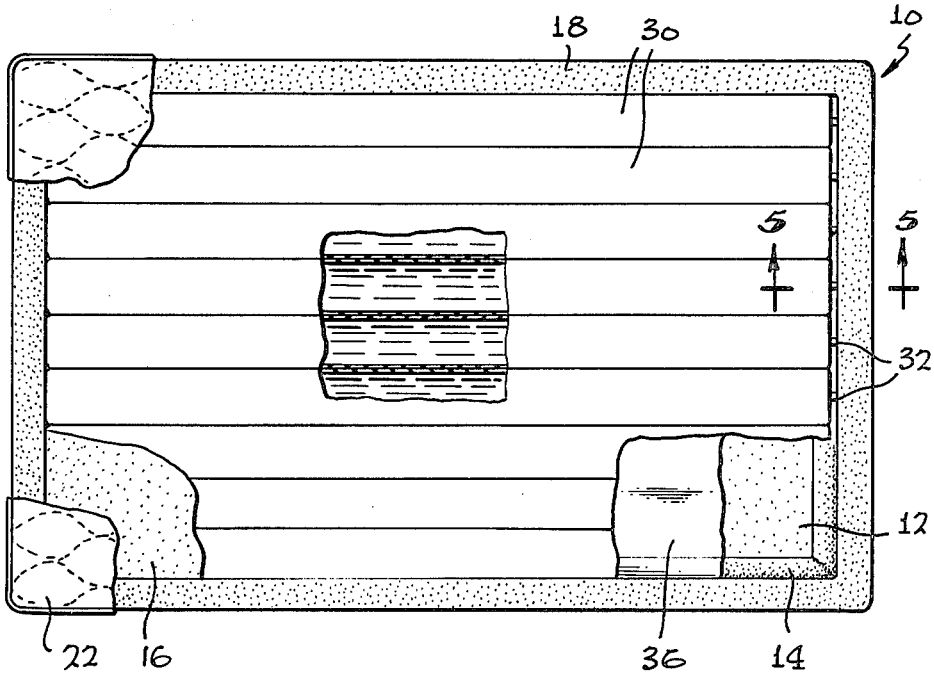
FIG. 2 is a plan view, partially broken away, of the waterbed mattress of FIG. 1.

In a fluid flotation sleeping surface 10 in accordance with the invention, referring now to FIGS. 1–5, the exterior of the structure is formed as a pair of bordered panels or frames, the outer margins of which have substantial height and register together so as to define an interior cavity or enclosed volume into which the water-filled structure may be incorporated. As best seen in FIGS. 1, 3 and 4, the bottom panel structure comprises a base urethane foam sheet 12 of approximately 1" thickness, to the outer periphery of which is secured a border member comprising a wedge-shaped or inclined foam wall 14, which may be unitary or made in individual segments, and which is joined to the margin of the base foam sheet 12 about its periphery. The area defined within the inclined surfaces of the wedges 14 comprises a well or open cavity under the principal sleeping surface of the mattress 10. The top panel has a centrally disposed urethane foam layer 16 of approximately 1" thickness, and an outer peripheral border of resilient foam 18 of rectangular cross-section that is substantially the height of the mattress, e.g. about 6". The mattress cover comprises a quilted top surface of polyurethane foam and polyester ticking, the foam layer 20 being of substantial height (approximately 1½" prior to quilting), so that the foam layer 20 is unified with the ticking 22 to provide a rich, finished appearance, together with a soft but firm surface fuel that has a substantial thermal insulative effect. A side quilted margin 24, which may be of plain fabric, extends around the periphery, and a marginal extension 26 of the ticking extends around the under side of the rectangular border 18, being attached to the inside of the border 18. Additionally, the top foam layer 16 may be attached, by adhesive, "Velcro" or other means to the under side of the cover quilt so that the cover panel is effectively a unitary structure. The foam border member 18 provides a firm edge support comparable to an inner spring mattress. Both the wedge-shaped walls 14 and the foam border 18 may be of foam of 1.5 to 4 lbs/ft$^3$ density with an Indentation Load Deflection of from 40 to 110 (nominally 80 in this example). These two panels or frames are of light weight and easily manipulated.

Within the interior of the enclosed volume thus defined when the top panel is registered over the bottom panel are disposed a plurality of water containers 30, here in the form of elongated tubes having a nominal diameter of approximately 5" when filled with water. For a king-sized sleeping surface, nine of these tubes 30 are sufficient, with tubes of this size each taking approximately 50 lbs. of water when substantially filled with a recommended volume of water. Because the tubes are not highly stressed when properly filled, the interior pressure in use is well within the desired limits of the tubes and they can have extremely long life. Each tube also includes a fill and drain valve 32 (FIG. 5 only). The tubes 30 are pliant and flexible, in the sense that they conform freely to the body of a user of the bed when the tube is substantially filled. The tubes can be marked with indicia to indicate recommended and maximum fill limits. However, they are substantially nonextensible or stretchable under pressure, so that pressure exerted in one region of a tube does not cause expansion. Any increase in internal pressure due to applied weight is absorbed by the reaction force exerted primarily by the tube 30 walls.

The tubes 30 can be filled to varying degrees so as to provide a range of support for the sleeping surface. The support can be uniform across the area, or varied with different tubes. With a double or large size bed, to be used by two persons, the support on each side can be tailored to the desires of each individual.

Under the tubes 30 and disposed across the top of the bottom panel, is a water barrier or collector sheet 36 which fits into the concavity defined by the top of the foam sheet 12 and within the inclined surfaces defined by the wedges 14. It is found advantageous, for cost and durability purposes, to use tubes 30 of approximately 20 mil vinyl, and the water barrier sheet 36 may be of 10 mil vinyl.

To assemble this fluid flotation sleeping surface, one need only lay down the bottom panel with the inclined surfaces of the wedges 14 facing upwardly, cover this structure with the water barrier sheet 36, fill the tubes 30 with water and place them lengthwise so as to be coextensive with the area defined by the lower panel, and then cover the lower panel and the tubes 30 with the cover panel structure. The entire unit may be placed on a box spring or other base for height adjustment, but no further action is required for use. In conforming to the body of a user, the tubes 30 provide a number of important functions. In the unstressed disposition, as shown in FIG. 3, the tubes tend under the water pressure to have a somewhat rounded configuration at the top surface. This provides no discontinuity from the standpoint of the user because of the intervening cover sheet 16 and the quilted foam 20. Similarly, this thick insulative covering provides adequate thermal insulation and there is typically no requirement for a water heater to be employed, which both requires energy usage and would tend to decrease tube life. The noise of air bubbles and shifting movement is also substantially eliminated by these top layers. Under the pressure exerted by the various parts of a user's body, the tubes yieldingly conform, but the great majority of the reactive force is provided by the walls of each individual tube 30, and not by the transmission of force to adjacent tubes. Thus as the water pressure in an individual tube is raised under an applied weight, there is no substantial increase of lateral pressure forces on the adjacent tubes, and no substantial wave motion transmitted throughout the sleeping surface. Consequently, the segmented character of the force absorbing structure limits the amount of movement and distortion which can take place in any direction, so that there is no need for a heavy rigid restraining framework. Further there is no need to provide cushioning so as to avoid hard edge effects. The rectangular border members 18 provide a firm but not hard edge support for someone sitting on the edge of the mattress, but because of the segmented construction are not subjected to outward bowing or bending under water pressure. The wedge members 14 need not withstand high lateral forces, but essentially provide a well for collection of leaking liquids and provide restraint against shifting of the tubes.

With this construction, therefore, a leak in an individual tube 30 affects only that tube and does not prevent usage of the entire sleeping surface. When the leakage is sufficient for ready detection of the condition by the user, the tube may be replaced and later repaired. At this point, even if all the water in an individual tube 30 has been lost, it will be safely retained within the well defined by the water barrier sheet 36. Each tube 30 contains only some 6 gallons of water, in comparison to the approximately 60 gallons in the bladder for a waterbed of comparable size.

It will be appreciated that a number of other expedients may be utilized in accordance with the invention. Tubes may be placed in the transverse direction, rather than along the longer axis of a mattress, so as to provide a different type of conformability, and adjustment for lesser support under the hips, for example. In addition, the water containers need not be tubes, inasmuch as they can be square, hexagons or circles, although it is preferred that the area of each container be sufficiently small so that the user does not rest all weight on one of the containers but the weight is distributed across a number of the water containers.

Although a number of variations and modifications of waterbed mattresses in accordance with the invention have been described, it will be appreciated that the invention is not limited thereto but encompasses all forms and variations within the scope of the appended claims.

What is claimed is:

1. A fluid flotation sleeping surface construction comprising:

a fitted pair of foam panel members, a first lower one of the panel members having an inclined peripheral resilient border attached thereto and having a planar surface member on the under side thereof, and the second upper one of the panel members having a resilient border of substantial height with a planar surface member attached on the upper side thereof, one of the borders registering about the other whereby an interior cavity is defined between the inner sides of the surface members and the inner portions of the resilient borders; and a plurality of separate, pliant but substantially non-stretchable water containers disposed in adjacent and abutting relation within the cavity and collectively substantially filling the volume thereof, each of the containers being sufficiently small to bear only a portion of the weight of a user and limiting interaction of pressure and wave motion between the containers.

2. The invention as set forth in claim 1 above, wherein the sleeping surface is rectangular in plan view, and wherein the water containers comprise a plurality of tubes disposed substantially parallel to the longer axis of the sleeping surface.

3. The invention as set forth in claim 2 above, wherein the sleeping surface includes in addition a water barrier sheet disposed on top of the lower panel under the water tubes and coextensive therewith.

4. The invention as set forth in claim 3 above, including in addition a quilted cover over the upper surface of the top panel member and having a foam interior, the foam having a thickness in excess of 1" prior to quilting.

5. The invention as set forth in claim 4 above, wherein the foam interior of the quilted cover has a nominal thickness of approximately 1½" prior to quilting.

6. The invention as set forth in claim 5 above, wherein the cover further includes a quilted side margin joined to the top quilted cover, and ticking joined to the lower edge of the side margin and attached to the inner surface of the border of the top panel, and wherein the resilient border of the upper panel member is of substantially rectangular cross-section, and the resilient border of the lower panel member is of wedge-shaped cross-section and has an angle of inclination slanting downwardly from the outer periphery thereof.

7. A fluid flotation sleeping surface comprising:

a foam base surface member including a raised, resilient, inclined peripheral border attached thereto to define an interior cavity;

a foam cover member having a resilient border of rectangular cross-section registering about the exterior of the peripheral border defining the interior cavity, and a top resilient layer attached thereto; and a plurality of separate, pliant but substantially non-stretchable water containers disposed in adjacent and abutting relation within the cavity and collectively substantially filling the volume thereof, each of the containers being sufficiently small to bear only a portion of the weight of a user and limiting interaction of pressure and wave motion between the containers.

8. The invention as set forth in claim 7 above, wherein the water containers are small enough in size so that the pressure exerted by a user applies to at least several containers and said containers are substantially not stretchable under normal user pressure and limit interaction of pressure and wave motion between containers.

9. The invention as set forth in claim 8 above, including in addition a water leakage barrier means disposed on the top surface of the base surface member and the adjacent peripheral border, under the plurality of containers.

10. The invention as set forth in claim 9 above, including in addition a top quilted member affixed to the cover member and extending coextensive with the top surface thereof, the quilted member having a foam interior and a nominal thickness before quilting of approximately 1½".

11. The invention as set forth in claim 10 above, wherein said sleeping surface is rectangular in cross-section and said water containers comprise a plurality of elongated tubes lying substantially parallel to the axis of elongation of the mattress.

12. The invention as set forth in claim 11 above, wherein the tubes comprise approximately 20 mil vinyl tubes including fill valve means.

13. The invention as set forth in claim 12 above, wherein the tubes are configured to contain on the order of 50 lbs. of water when substantially filled to a useable level.

14. The invention as set forth in claim 13 above, wherein the base surface member and the resilient layer of the cover member comprise approximately 1" layers of urethane foam.

15. The invention as set forth in claim 14 above, wherein said cover member further includes quilted side margin means coupled to the top quilted member, and ticking margin means attached to the inner side of the resilient border of the cover member.

* * * * *